United States Patent [19]

Bienek

[11] 4,220,378

[45] Sep. 2, 1980

[54] PLATE BEARING

[76] Inventor: Artur Bienek, Wilh. Leuschner-Str. 35, D-5500 Trier, Fed. Rep. of Germany

[21] Appl. No.: 41,317

[22] Filed: May 22, 1979

[30] Foreign Application Priority Data

Nov. 25, 1977 [DE] Fed. Rep. of Germany ..... 2752589

[51] Int. Cl.[3] ..... F16C 35/02

[52] U.S. Cl. ..... 308/25; 308/2R

[58] Field of Search ..... 308/25, 2, 244, 15, 308/22, 160; 52/167, 573

[56] References Cited

U.S. PATENT DOCUMENTS 4,152,799 5/1979 Koster et al. ..... 52/167

FOREIGN PATENT DOCUMENTS 2007767 9/1971 Fed. Rep. of Germany ..... 308/25

2157750 5/1973 Fed. Rep. of Germany .

*Primary Examiner*—Lenard A. Footland

*Attorney, Agent, or Firm*—Peter K. Kontler

[57] ABSTRACT

A height adjustable bearing for the plates of flat roofs or the like consists of a base plate, a central cross member, and in each of four quadrants of the base plate a respective bearing pedestal, a pair of wedge-shaped blocks between the bearing pedestals and a bearing brass, and a support for a plate. Each pair of blocks is connected together by a bolt in screw threaded engagement with the blocks such that rotations of an actuating element turns the bolt and draws the blocks together thereby raising or lowering the support to adjust the height of the supported plate.

10 Claims, 6 Drawing Figures

Fig. 6
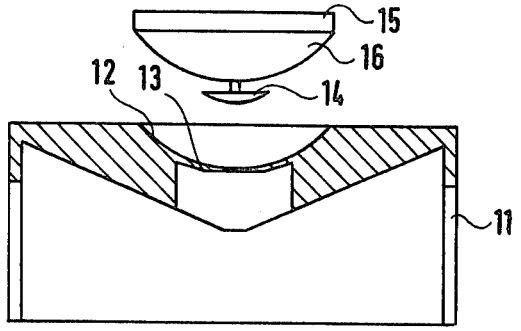
Fig. 5
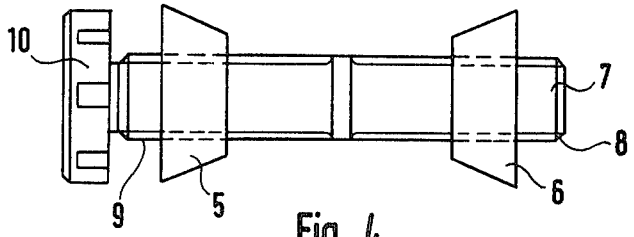
Fig. 4
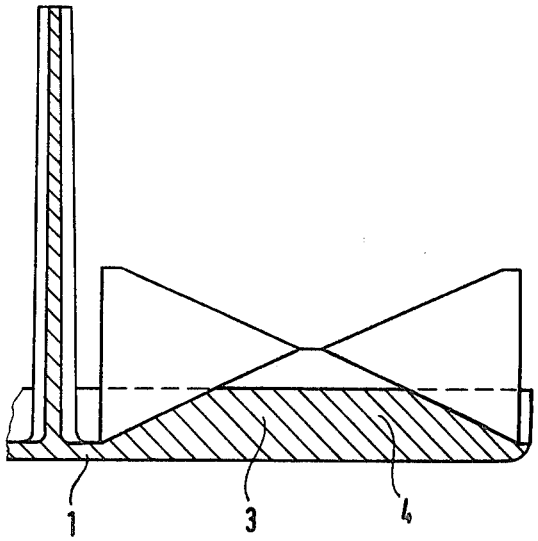
Fig. 3

PLATE BEARING

BACKGROUND TO THE INVENTION

The invention relates to a plate bearing, adjustable in height, for plates that are to be laid in open-jointed manner.

Known plate bearings of this type comprise two blocks which are provided with slopes and in which internal threads are disposed. At least one threaded bolt is in screw-threaded engagement with the above-mentioned blocks, such that rotation of the bolt about a longitudinal axis results in movement of the blocks simultaneously in opposite directions. An actuating element, preferably at one end of the threaded bolt, is mounted in such a way that the thread bolt can be rotated about the longitudinal axis, and a bearing pedestal is provided, preferably having two inclined planes, on which the above-mentioned blocks rest and can be guided. The bearing pedestal is mounted on a bearing plate which rests preferably on the above-mentioned blocks, which can be achieved by working in suitable inclined planes. In the upper surface of the bearing pedestal there is situated a hollow in the form of a segment of a sphere as well as a support, which preferably consists of a segment of a sphere with an extension, in such a way that it rests in the above-mentioned spherical indentation and can be inclined with rest to the substrate.

In the case of the known bearing of this kind (German Patent No. 21 57 750), the support on which the plate that is to be supported rests is designed as a bearing sleeve having an internal thread, into which, for the purposes of height adjustment, a bolt is in screw-threaded engagement with an approximately centrally situated actuating element.

This bearing sleeve produces, for the plate that is to be supported, a bearing surface whose inclination with respect to the plane of the substrate is fixed. The plate to be supported there generally does not rest in planar manner, but loads the above-mentioned bearing sleeve at that point at which it contacts the bearing sleeve, so that it perforce very easily slips out of its originally intended position when the plates are trodden on, and deforms the joint crosses.

A further disadvantage of the described known bearing consists in that generally only a fraction of the thread present on the outside of the thread bolt is tapped into the internal thread of the bearing sleeve, so that only a small portion of the thread has to bear the entire weight of the plate, thereby possibly resulting in stripping of the thread turns and in any event producing a non-uniform loading capacity of the bearing as a function of the distance between the substrate and the bearing sleeve. A further disadvantage of this bearing consists, finally, in that the bearing point at which the plate is supported by the bearing shifts during the height adjustment of the bearing, so that the plate itself is sometimes more heavily loaded at the edge, and on other occasions is more heavily loaded towards the centre of the plate.

Therefore the invention has set itself the aim of further developing the above-described bearing to the effect that the plate that is to be supported always rests in areal manner on the bearing, in order to prevent the join displacement, to the effect that the loadability remains constant over the entire height adjustment region of the bearing, and to the effect that the support point of the plate does not shift when the height adjustment of the plate is altered.

BRIEF SUMMARY OF THE INVENTION

With the above aim in view the present invention provides a height-adjustable bearing for plates to be laid in open-joint manner, the bearing comprising a base plate, at least two blocks on the base plate each provided with an internal thread, at least one bolt adapted for screw-threaded engagement with the blocks and having two oppositely orientated threaded portions, an actuating element mounted at one end of the bolt, at least one bearing pedestal on the base plate, on which said blocks can be displaced in sliding manner, a bearing brass which rests on said blocks, and a support on the bearing brass which comprises a segment of a sphere mounted for rotation in a spherical segment in the upper side of the bearing brass, the bearing pedestal being formed at those regions where it contacts the blocks as inclined planes.

The areal support of the plate that is to be supported is ensured in that the support on which the plate that is to be supported lies is formed from an extension onto which a segment of a sphere is placed, which rests so as to be rotary in a spherical segment which has the same radius of curvature as the segment of a sphere.

If the inclination of the plate relative to the substrate does not exceed a predetermined maximum value, the support can be realised even more simply as a segment of a sphere having no extension.

A uniform loadability of the bearing over the entire height adjustment region is achieved in that either on the bearing plate a bearing pedestal in the form of oppositely-placed wedges is present, on which two blocks having corresponding inclined plane, which carry a bearing brass, rest in areal manner.

The inclined planes can equally well be situated on the bearing brass. Naturally one selects the inclination of the bearing surfaces on the blocks and inclined planes the same, so that the bearing brass rests in areal manner on the blocks.

Advantageously the bearing pedestal, in the form of inclined planes on which the blocks rest in areal manner and can be shifted, and the underside of the bearing brass, will both be made as two inclined planes which rest in areal manner on appropriately inclined sides of the blocks. The height adjustment of the plate bearing is effected in that the blocks are shifted with the aid of a thread bolt in opposite directions, so that they on the one hand slip upwards on the bearing pedestal, and on the other hand the bearing brass is shifted by the blocks simultaneously upwards.

A mirror-inverted construction of the plate bearing with respectively two blocks or four inclined planes ensures that the resulting force is exerted on the plate always at the same support point. The advantage of the known above-described bearing from which a start was made, namely the possibility of the stepless height adjustability of the bearing even after the laying of the plates, is ensured in its entirety also in the case of the invention, since the thread bolt which moves the blocks in opposite directions can be provided at one end with an actuating element—preferably a knob—which can be moved through the joint between the plates.

The support in the form of a segment of a sphere can also be situated on the plate immediately upon production. Then four bearings of the above-described kind can be combined on one base plate with a centering cross in such a way that no joint displacement occurs, although the plates produced in this way can at any time be lifted off from the bearing like conventional plates.

BRIEF DESCRIPTION OF THE DRAWINGS

The drawings show one possible embodiment of the above described bearing.

FIG. 3 shows the base plate and a bearing pedestal in side view, sectioned;

FIG. 4 shows thread bolt, blocks and actuating element in a side view;

FIG. 5 shows the bearing brass in section from the side; and

FIG. 6 shows finally the support in side view.

DESCRIPTION OF THE PREFERRED EMBODIMENT

Figure 1:
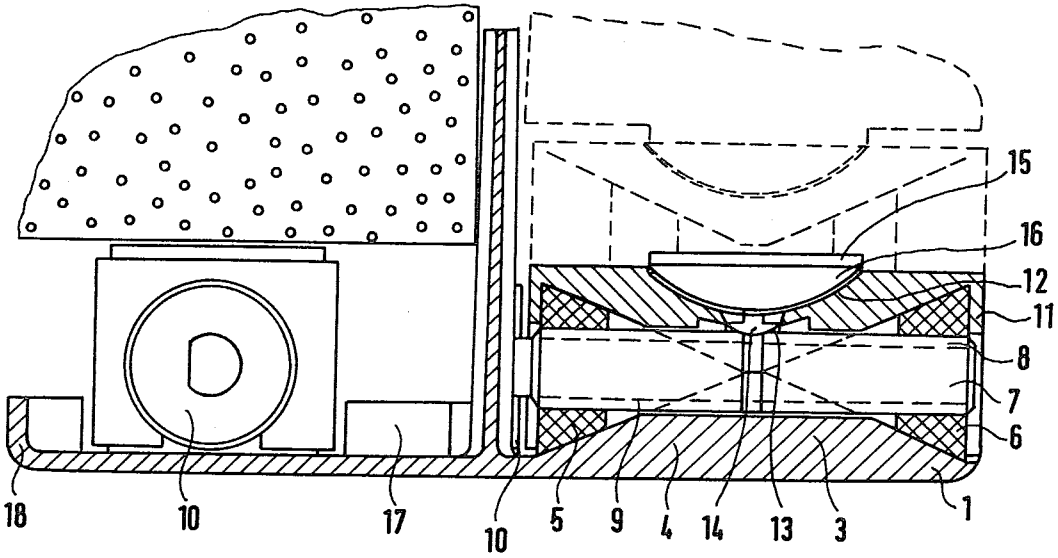
FIGS. 1 and 2 show a bearing plate in accordance with the invention in top plan view and in side view, partially sectioned.
Figure 2:
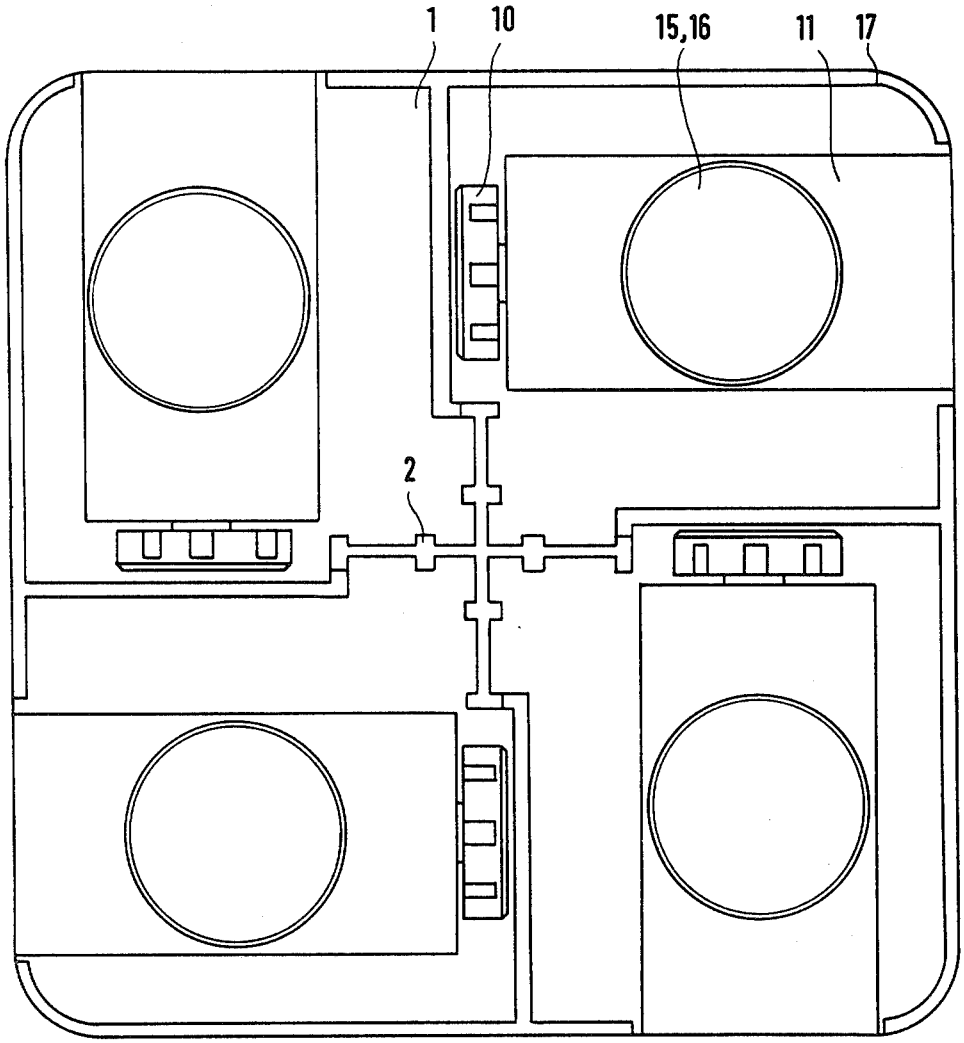

The bearing shown in FIGS. 1 and 2 consists of a base plate 1, which has centrally a centering cross 2, and four bearing pedestals, which each consist of two joined-up wedges 3 and 4. On the inclined planes which are provided in this way in each case two blocks 5 and 6, which are provided with internal threads of mutually opposite hardedners, can be moved in mutually opposite directions with the aid of the thread bolt 7, which has two threaded portions 8 and 9 of mutually opposite hardedners. The thread bolt 7 can be rotated with the actuating element 10, which is designed as a knob having radial slots, about its longitudinal axis, when the actuating element is twisted through the joint, for example with a pin fitting into the slots. Resting on the above-mentioned blocks 5 and 6 is the bearing brass 11, the underside of which similarly has the form of two inclined planes 12 which rests in areal manner on the blocks. If the blocks are drawn together with the thread bolts, then the surface of the bearing brass 11 rises.

Worked-in in the surface of the bearing brass 11 is a spherical segment 12, as well as a detent bore 13, by which the mushroom-shaped extension 14 on the support, which consists of the cylindrical extension 15, the segment of a sphere 16 and the mushroom-shaped extension 14, is engaged into the cavity in such a way that the support on the one hand rests in the spherical indentation and upon transportation does not fall out of the spherical segment, and on the other hand can be inclined by the necessary angle with respect to the substrate.

The bearing pedestals are arranged in the four quadrants of the base plate in such a way that the actuating elements 10 can be operated through the joints, to which also the length of the thread bolts is coordinated. To increase the stability, stiffenings spars 17 are mounted on the base plate 1, the thickness of which can be adapted additionally to a necessary greater height compensation. The lower edges of the base plate 1 are rounded off at the corners 18, in order to avoid possible damage of soft underlays—for example roof sheathings.

Because both bearing pedestal and bearing brass are constructed from inclined planes, the stroke is twice as big as if only either the bearing brass or the bearing pedestal were constructed from inclined planes.

Worked both into the surface of the bearing pedestals 3 and into the bearing surfaces of the bearing brasses 11 are thread-bolt lead-throughs, of such a kind that the thread bolts can be rotated about their longitudinal axis until the undersides of the bearing brasses 11 and the surfaces of the bearing pedestals contact in the centre.

In FIG. 1 it is shown how the support can be mounted without a mushroom-shaped extension on the plate that is to be supported. A special support can, in this case, be dispensed with.

The centering cross serves on the one hand to produce joints between the plates that are to be supported, and on the other hand to allow the joints to run at right angles to one another.

I claim:

1. A height-adjustable bearing for plates to be laid in open-joint manner, the bearing comprising a base plate, at least two blocks on the base plate each provided with an internal thread, at least one bolt adapted for screw-threaded engagement with the blocks and having two oppositely orientated threaded portions, an actuating element mounted at one end of the bolt, at least one bearing pedestal on the base plate, on which said blocks can be displaced in sliding manner, a bearing brass which rests on said blocks, and a support on the bearing brass which comprises a segment of a sphere mounted for rotation in a spherical segment in the upper side of the bearing brass, the pearing pedestal being formed at those regions where it contacts the blocks as inclined planes.

2. The bearing of claim 1 wherein mounted on the support and bearing brass are devices which prevent any dropping-out of the support out of the spherical segment.

3. The bearing of claim 1 wherein the support is connected securely to the plate that is to be supported.

4. The bearing of claim 1 wherein the actuating element is a knob having radial slots or bores.

5. The bearing of claim 1 wherein a centering cross is arranged centrally on the base plate.

6. A height-adjustable bearing for plates to be laid in open-joint manner, the bearing comprising a base plate, at least two blocks on the base plate each provided with an internal thread, at least one bolt adapted for screw threaded engagement with the blocks and having two oppositely orientated threaded portions, an actuating element mounted at one end of the bolt, at least one bearing pedestal on the base plate, on which said blocks can be displaced in sliding manner, a bearing brass which rests on said blocks, and a support on the bearing brass which comprises a segment of a sphere mounted for rotation in a spherical segment in the upper side of the bearing brass, the underside of the bearing brass being formed at those regions where it contacts the blocks, as inclined planes.

7. The bearing of claim 6 wherein mounted on the support and bearing brass are devices which prevent any dropping-out of the support out of the spherical segment.

8. The bearing of claim 6 wherein the support is connected securely to the plate that is to be supported.

9. The bearing of claim 6 wherein the actuating element is a knob having radial slots or bores.

10. The bearing of claim 6 wherein a centering cross is arranged centrally on the base plate.

* * * * *